US008979512B2

(12) United States Patent
Chang et al.

(10) Patent No.: US 8,979,512 B2
(45) **Date of Patent: *Mar. 17, 2015**

(54) OIL-RETAINING BEARING HAVING MAGNETIC STABILIZER

(75) Inventors: Bor-Haw Chang, New Taipei (TW); Shu-Fen Liu, New Taipei (TW)

(73) Assignee: Asia Vital Components (Chengdu) Co., Ltd., Chengdu (CN)

( * ) Notice: Subject to any disclaimer, the term of this patent is extended or adjusted under 35 U.S.C. 154(b) by 350 days.

This patent is subject to a terminal disclaimer.

(21) Appl. No.: 13/311,181

(22) Filed: Dec. 5, 2011

(65) Prior Publication Data

US 2013/0142645 A1 Jun. 6, 2013

(51) Int. Cl.
*F04B 35/04* (2006.01)
*F03B 3/12* (2006.01)

(52) U.S. Cl.
USPC ..... 417/423.13; 417/423.1; 417/423.12; 417/353; 417/354; 415/229; 384/118

(58) Field of Classification Search
USPC ..... 417/423.1, 423.13, 353, 354, 423.12; 384/446
See application file for complete search history.

(56) References Cited

U.S. PATENT DOCUMENTS

| | | | | |
|---|---|---|---|---|
| 5,469,008 | A * | 11/1995 | Nakajima et al. | 310/90.5 |
| 5,872,409 | A * | 2/1999 | Jung | 310/68 B |
| 5,994,803 | A * | 11/1999 | Jung | 310/51 |
| 6,356,408 | B1 * | 3/2002 | Nii et al. | 360/98.07 |
| 6,567,268 | B1 * | 5/2003 | Hsieh | 361/695 |
| 6,700,241 | B1 * | 3/2004 | Horng et al. | 310/67 R |
| 6,784,581 | B1 * | 8/2004 | Chen et al. | 310/90.5 |

* cited by examiner

*Primary Examiner* — Bryan Lettman
*Assistant Examiner* — Timothy P Solak
(74) *Attorney, Agent, or Firm* — C. G. Mersereau; Nikolai & Mersereau, P.A.

(57) ABSTRACT

An oil-retaining bearing fan device includes a fan base seat, at least one oil-retaining bearing and at least one magnetic member. The oil-retaining bearing is disposed in a bearing hole of the fan base seat. The oil-retaining bearing has at least one receiving hole for receiving the magnetic member therein. The magnetic member serves to apply a magnetic attraction force to a shaft of the fan device to make the shaft quickly restore to its optimal operation position so as to reduce wear and lower the noises and vibration of the fan device in operation. Therefore, the lifetime of the fan device can be prolonged.

4 Claims, 9 Drawing Sheets

OIL-RETAINING BEARING HAVING MAGNETIC STABILIZER

BACKGROUND OF THE INVENTION

1. Field of the Invention

The present invention relates generally to an oil-retaining bearing fan device, and more particularly to an oil-retaining bearing fan device including at least one magnetic member. The magnetic member serves to apply a magnetic attraction force to a shaft of the fan device to make the shaft quickly restore to its optimal operation position so as to reduce wear and lower the noises and vibration of the fan device in operation. Therefore, the lifetime of the fan device can be prolonged.

2. Description of the Related Art

Recently, all kinds of electronic information products (such as computers) have been more and more popularly used and widely applied to various fields. There is a trend to increase processing speed and expand access capacity of the electronic information products. Therefore, the electronic components of the electronic information products have operated at higher and higher speed. When operating at high speed, the electronic components generate high heat at the same time.

With a computer host taken as an example, the central processing unit (CPU) in the computer host generates most of the heat generated by the computer host in operation. In case the heat is not efficiently dissipated, the temperature of the CPU will rise very quickly to cause deterioration of the execution efficiency. When the accumulated heat exceeds a tolerable limit, the computer will crash or even burn down in some more serious cases. Moreover, for solving the problem of electromagnetic radiation, the computer host is often enclosed in a computer case. This will affect the dissipation of the heat generated by the computer host. Therefore, it has become a critical issue how to quickly conduct out and dissipate the heat generated by the CPU and other heat-generating components.

Conventionally, a heat sink and a cooling fan are arranged on the CPU to quickly dissipate heat. One side of the heat sink has multiple radiating fins, while the other side of the heat sink is free from any radiating fin. The surface of the other side of the heat sink directly contacts the CPU for conducting heat to the radiating fins. The radiating fins serve to dissipate the heat by way of radiation. In addition, the cooling fan cooperatively forcedly drives airflow to quickly carry away the heat.

FIG. 1 is a perspective sectional assembled view of a conventional oil-retaining bearing cooling fan. The cooling fan 1 includes a fan base seat 11. A bearing cup 111 protrudes from the fan base seat 11. A bearing 12 is disposed in the bearing cup 111. A fan impeller 13 is assembled with the fan base seat 11. The fan impeller 13 has multiple blades 131 annularly arranged along outer circumference of the fan impeller 13. The fan impeller 13 further has a shaft 132 extending from an inner side of the fan impeller 13. The shaft 132 is disposed and located in the bearing 12. An oil film 121 is filled between the bearing 12 and the shaft 132. The relative position between the fan base seat 11, the bearing 12 and the fan impeller 13 is tested and adjusted to an optimal operation position where the shaft 132 of the cooling fan 1 can stably rotate within the bearing 12 under support of the oil film 121. Accordingly, in operation of the cooling fan 1, the shaft 132 rotates within the bearing 12 in an operation position relative to the bearing 12 only under the support force of the oil film 121. However, the support force of the oil film 121 provided for the shaft 132 is smaller than the eccentric force applied to the shaft 132 in operation of the cooling fan 1. Therefore, the shaft 132 and the bearing 12 will still abrade and collide each other. Also, in case the cooling fan 1 is collided by an alien article to make the shaft 132 deflected from its true position, the shaft 132 will collide the bearing 12 and vibrate in operation. Under such circumstance, in operation, the cooling fan 1 will vibrate and make noises due to the deflection of the shaft 132. Moreover, the wear between the shaft 132 and the bearing 12 will be increased to shorten lifetime of the cooling fan 1. The shaft 132 may be restored to its optimal operation position under the support force of the oil film 121. However, after squeezed, it takes longer time for the oil film 121 to recover so that the shaft 132 also needs longer time to restore to its optimal operation position. As a result, the noises will last longer.

According to the above, the conventional oil-retaining bearing cooling fan has the following shortcomings:

1. The conventional oil-retaining bearing cooling fan tends to vibrate and make noises.
2. The conventional oil-retaining bearing cooling fan is more subject to wear.
3. The noises made by the conventional oil-retaining bearing cooling fan will last longer.
4. The lifetime of the conventional oil-retaining bearing cooling fan is shorter.

SUMMARY OF THE INVENTION

A primary object of the present invention is to provide an oil-retaining bearing fan device including at least one magnetic member. The magnetic member serves to apply a magnetic attraction force to a shaft of the fan device to make the shaft quickly restore to its optimal operation position so as to reduce wear and lower the noises and vibration of the fan device in operation. Therefore, the lifetime of the fan device can be prolonged.

A further object of the present invention is to provide the above oil-retaining bearing fan device, which can quickly restore to a stably operating state.

To achieve the above and other objects, the oil-retaining bearing fan device of the present invention includes a fan base seat, at least one oil-retaining bearing, at least one magnetic member and a fan impeller. The fan base seat has a bearing cup on one side. The bearing cup has a bearing hole. The oil-retaining bearing is disposed in the bearing hole. The oil-retaining bearing has a shaft hole and at least one receiving hole. The magnetic member is disposed in the receiving hole. The fan impeller has multiple blades and a shaft. The shaft is rotatably disposed in the shaft hole. The magnetic member serves to apply a magnetic attraction force to the shaft to make the shaft quickly restore to its optimal operation position so as to reduce wear and lower the noises and vibration of the fan device in operation. Therefore, the lifetime of the fan device can be prolonged.

According to the above arrangement, the present invention has the following advantages:

1. The noises and vibration of the fan device are lowered.
2. The wear of the fan device is reduced.
3. The lasting time of the noises is shortened.
4. The lifetime of the fan device is prolonged.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
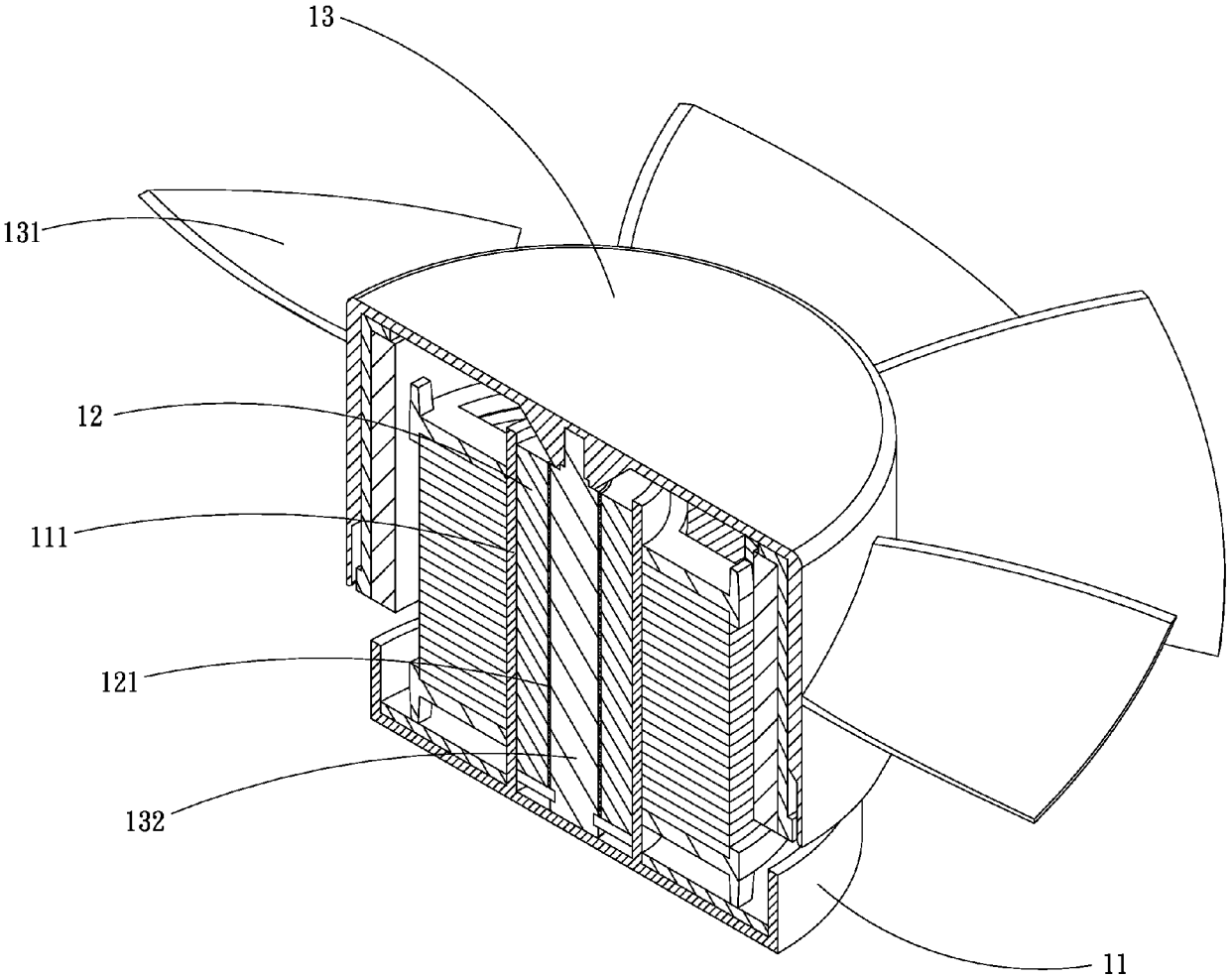
(PRIOR ART) Fig. 1
FIG. 1 is a perspective sectional assembled view of a conventional oil-retaining bearing cooling fan.
Figure 2:
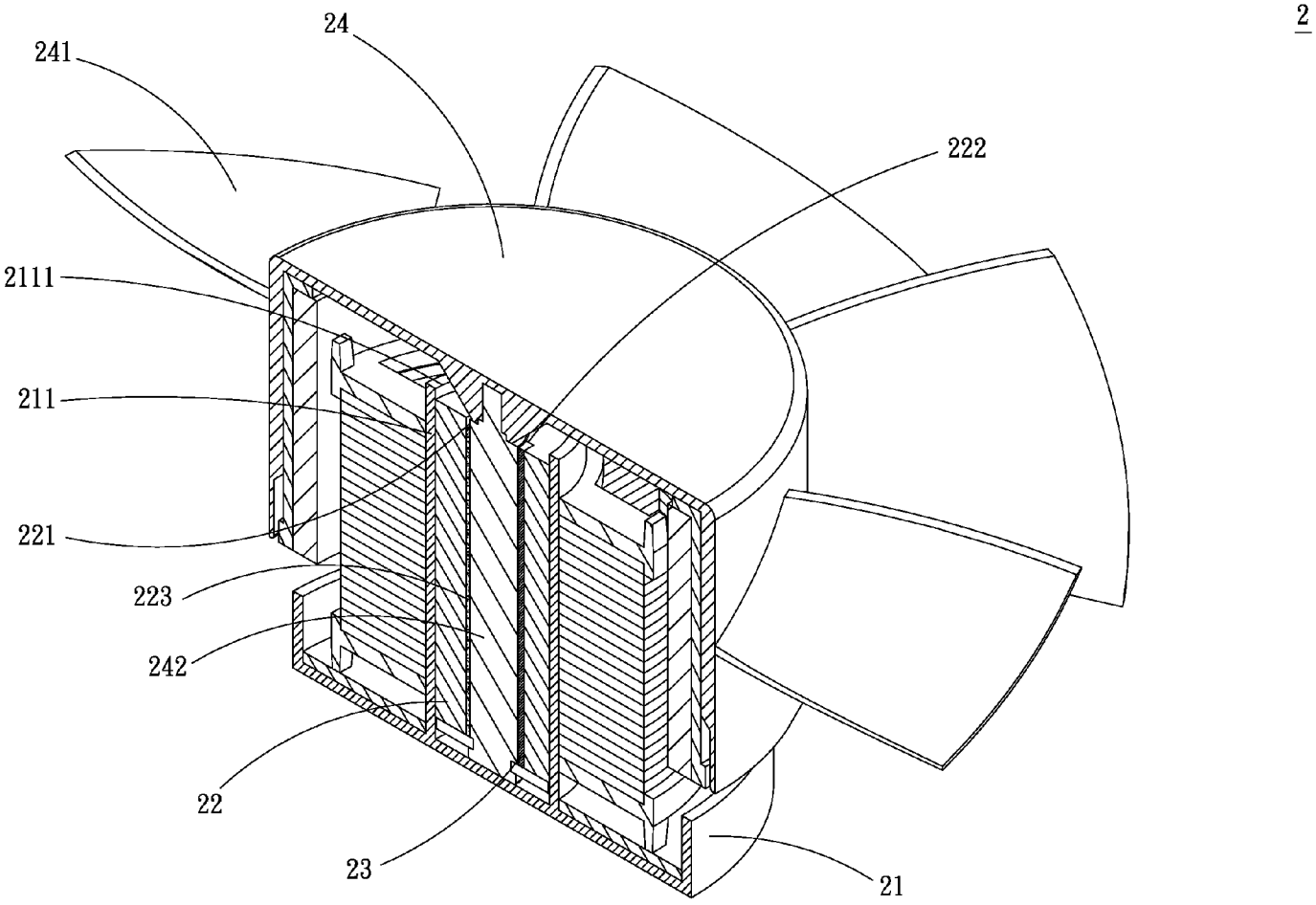
FIG. 2 is a perspective sectional assembled view of a first embodiment of the present invention.
Figure 3:
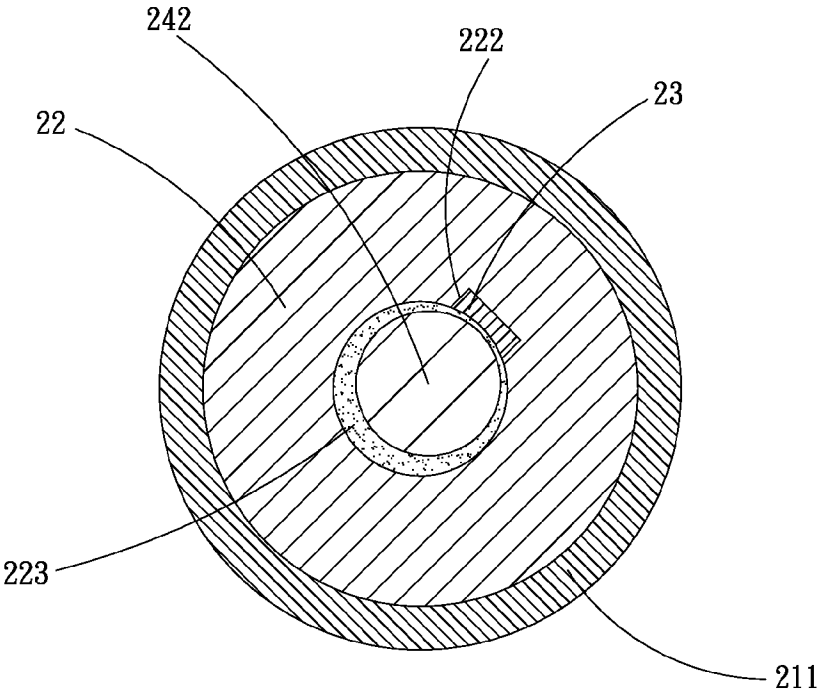
FIG. 3 is a plane view of a part of the first embodiment of the present invention.

Please refer to FIGS. 2 and 3. FIG. 2 is a perspective sectional assembled view of a first embodiment of the present invention. FIG. 3 is a plane view of a part of the first embodiment of the present invention. According to the first embodiment, the oil-retaining bearing fan device 2 of the present invention includes a fan base seat 21, an oil-retaining bearing 22, a magnetic member 23 and a fan impeller 24. The fan base seat 21 has a bearing cup 211 on one side. The bearing cup 211 has an internal bearing hole 2111 in which the oil-retaining bearing 22 is disposed. The oil-retaining bearing 22 has an internal shaft hole 221 and at least one receiving hole 222.

In this embodiment, the receiving hole 222 is disposed on an inner circumference of the oil-retaining bearing 22. The magnetic member 23 is disposed in the receiving hole 222. The magnetic member 23 is selected from a group consisting of magnetic iron, magnetic powder body and magnet. The fan impeller 24 includes multiple blades 241 and a shaft 242. The blades 241 are annularly arranged along outer circumference of the fan impeller 24. The fan impeller 24 is disposed on the bearing cup 211 with the shaft 242 rotatably disposed in the shaft hole 221. A hydraulic layer 223, which is an oil film, is filled between the shaft 242 and a wall of the shaft hole 221. When mounting the shaft 242 into the shaft hole 221, it is necessary to test and adjust the relative position between the fan base seat 21, the oil-retaining bearing 22 and the fan impeller 24 to an optimal operation position. When adjusting the position, the magnetic member 23 received in the receiving hole 222 applies a magnetic attraction force to the shaft 242. In the meantime, the hydraulic layer 223 provides a support force for the shaft 242. By means of the magnetic attraction force of the magnetic member 23 and the support force of the hydraulic layer 223, the shaft 242 can be effectively located in the optimal operation position. In operation of the fan impeller 24, under the magnetic attraction force of the magnetic member 23, the shaft 242 can be kept in the optimal operation position. Accordingly, the stability of operation of the shaft 242 within the oil-retaining bearing 22 can be enhanced to reduce wear and lower the noises and vibration of the fan device in operation. Therefore, the lifetime of the fan device can be prolonged.

On the other hand, in case in the oil-retaining bearing fan device 2 is collided by an alien article to make the shaft 242 deflected from its true position, the shaft 242 will collide the oil-retaining bearing 22 and vibrate. Under such circumstance, the magnetic member 23 will apply a magnetic attraction force to the shaft 242, making the shaft 242 quickly restore to its optimal operation position so as to reduce wear and lower the noises and vibration of the fan device in operation. Therefore, the lifetime of the fan can be prolonged.

Figure 4:
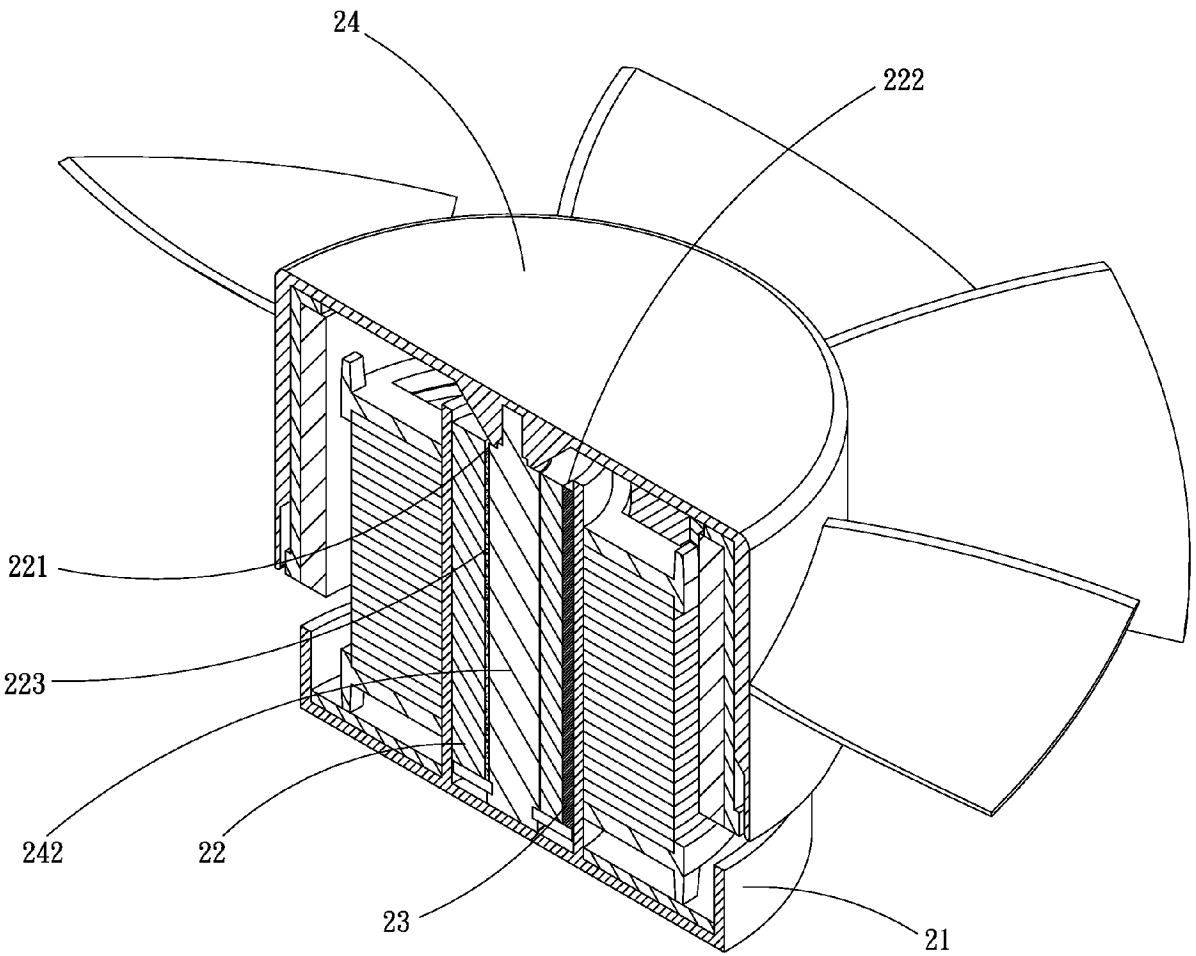
FIG. 4 is a perspective sectional assembled view of a second embodiment of the present invention.
Figure 5:
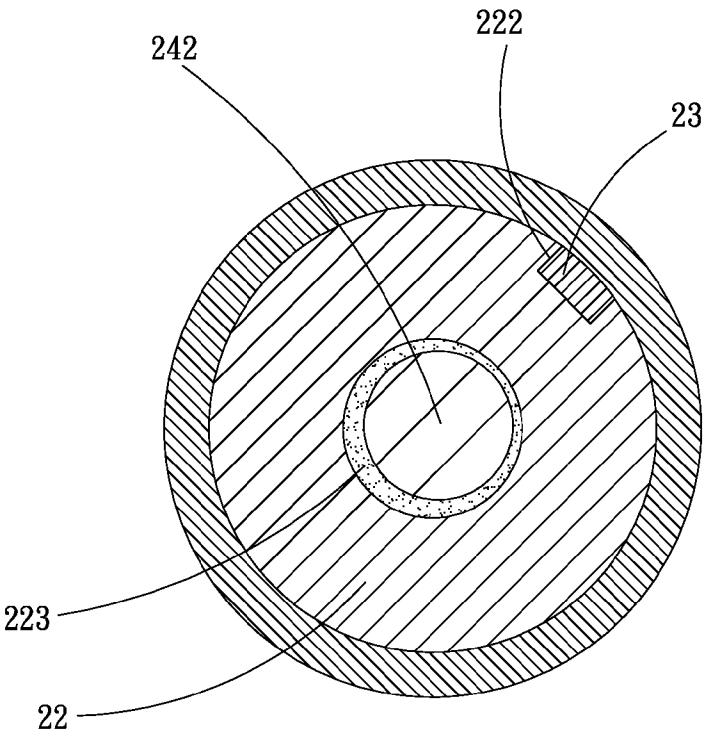
FIG. 5 is a plane view of a part of the second embodiment of the present invention.

Please refer to FIGS. 4 and 5. FIG. 4 is a perspective sectional assembled view of a second embodiment of the present invention. FIG. 5 is a plane view of a part of the second embodiment of the present invention. The second embodiment is substantially identical to the first embodiment in component, connection relationship and operation and thus will not be repeatedly described hereinafter. The second embodiment is different from the first embodiment in that the receiving hole 222 is disposed on an outer circumference of the oil-retaining bearing 22. The magnetic member 23 is disposed in the receiving hole 222. The shaft 242 is rotatably disposed in the shaft hole 221. The hydraulic layer 223 is filled between the shaft 242 and the wall of the shaft hole 221. When mounting the shaft 242 into the shaft hole 221, it is necessary to test and adjust the relative position between the fan base seat 21, the oil-retaining bearing 22 and the fan impeller 24 to an optimal operation position. When adjusting the position, the magnetic member 23 received in the receiving hole 222 applies a magnetic attraction force to the shaft 242. In the meantime, the hydraulic layer 223 provides a support force for the shaft 242. By means of the magnetic attraction force of the magnetic member 23 and the support force of the hydraulic layer 223, the shaft 242 can be effectively located in the optimal operation position. In operation of the fan impeller 24, under the magnetic attraction force of the magnetic member 23, the shaft 242 can be kept in the optimal operation position. Accordingly, the stability of operation of the shaft 242 within the oil-retaining bearing 22 can be enhanced to reduce wear and lower the noises and vibration of the fan device in operation. Therefore, the lifetime of the fan device can be prolonged. On the other hand, in case in the oil-retaining bearing fan device 2 is collided by an alien article to make the shaft 242 deflected from its true position, the magnetic member 23 received in the receiving hole 222 will apply a magnetic attraction force to the shaft 242 to make the shaft 242 quickly restore to its optimal operation position so as to reduce wear and lower the noises and vibration of the fan device in operation. Therefore, the lifetime of the fan device can be prolonged.

Figure 6:
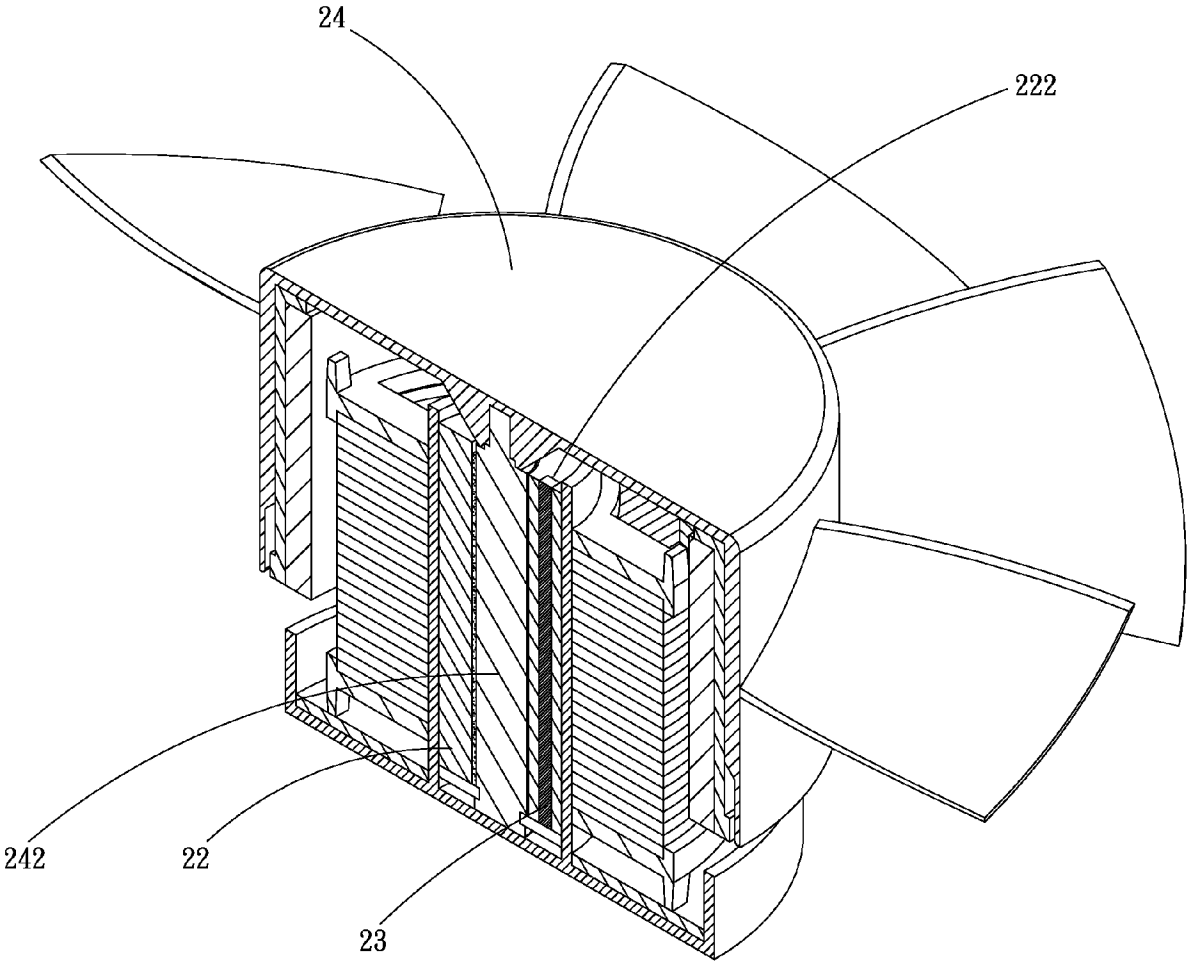
FIG. 6 is a perspective sectional assembled view of a third embodiment of the present invention.
Figure 7:
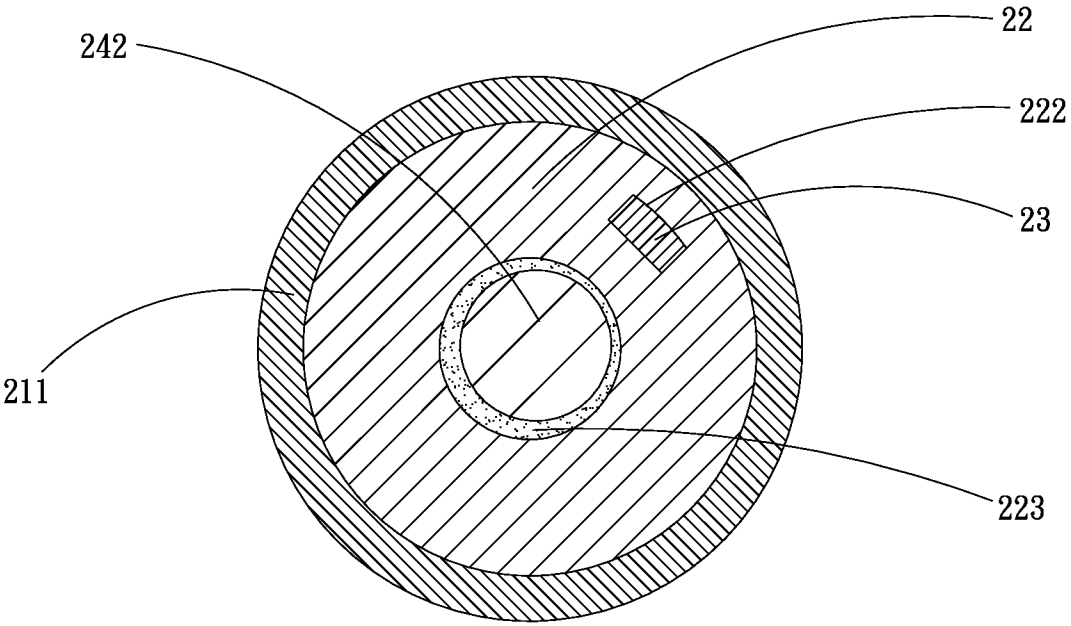
FIG. 7 is a plane view of a part of the third embodiment of the present invention.

Please refer to FIGS. 6 and 7. FIG. 6 is a perspective sectional assembled view of a third embodiment of the present invention. FIG. 7 is a plane view of a part of the third embodiment of the present invention. The third embodiment is substantially identical to the first embodiment in component, connection relationship and operation and thus will not be repeatedly described hereinafter. The third embodiment is different from the first embodiment in that the receiving hole 222 is disposed in the oil-retaining bearing 22 between the inner and outer circumferences thereof. The magnetic member 23 is disposed in the receiving hole 222. The shaft 242 is rotatably disposed in the shaft hole 221. The hydraulic layer 223 is filled between the shaft 242 and the wall of the shaft hole 221. When mounting the shaft 242 into the shaft hole 221, it is necessary to test and adjust the relative position between the fan base seat 21, the oil-retaining bearing 22 and the fan impeller 24 to an optimal operation position. When adjusting the position, the magnetic member 23 received in the receiving hole 222 applies a magnetic attraction force to the shaft 242. In the meantime, the hydraulic layer 223 provides a support force for the shaft 242. By means of the magnetic attraction force of the magnetic member 23 and the support force of the hydraulic layer 223, the shaft 242 can be effectively located in the optimal operation position. In operation of the fan impeller 24, under the magnetic attraction force of the magnetic member 23, the shaft 242 can be kept in the optimal operation position. Accordingly, the stability of operation of the shaft 242 within the oil-retaining bearing 22 can be enhanced to reduce wear and lower the noises and vibration of the fan device in operation. Therefore, the lifetime of the fan device can be prolonged. On the other hand, in case in the oil-retaining bearing fan device 2 is collided by an alien article to make the shaft 242 deflected from its true position, the magnetic member 23 received in the receiving hole 222 will apply a magnetic attraction force to the shaft 242 to make the shaft 242 quickly restore to its optimal operation position so as to reduce wear and lower the noises and vibration of the fan device in operation. Therefore, the lifetime of the fan device can be prolonged.

Figure 8:
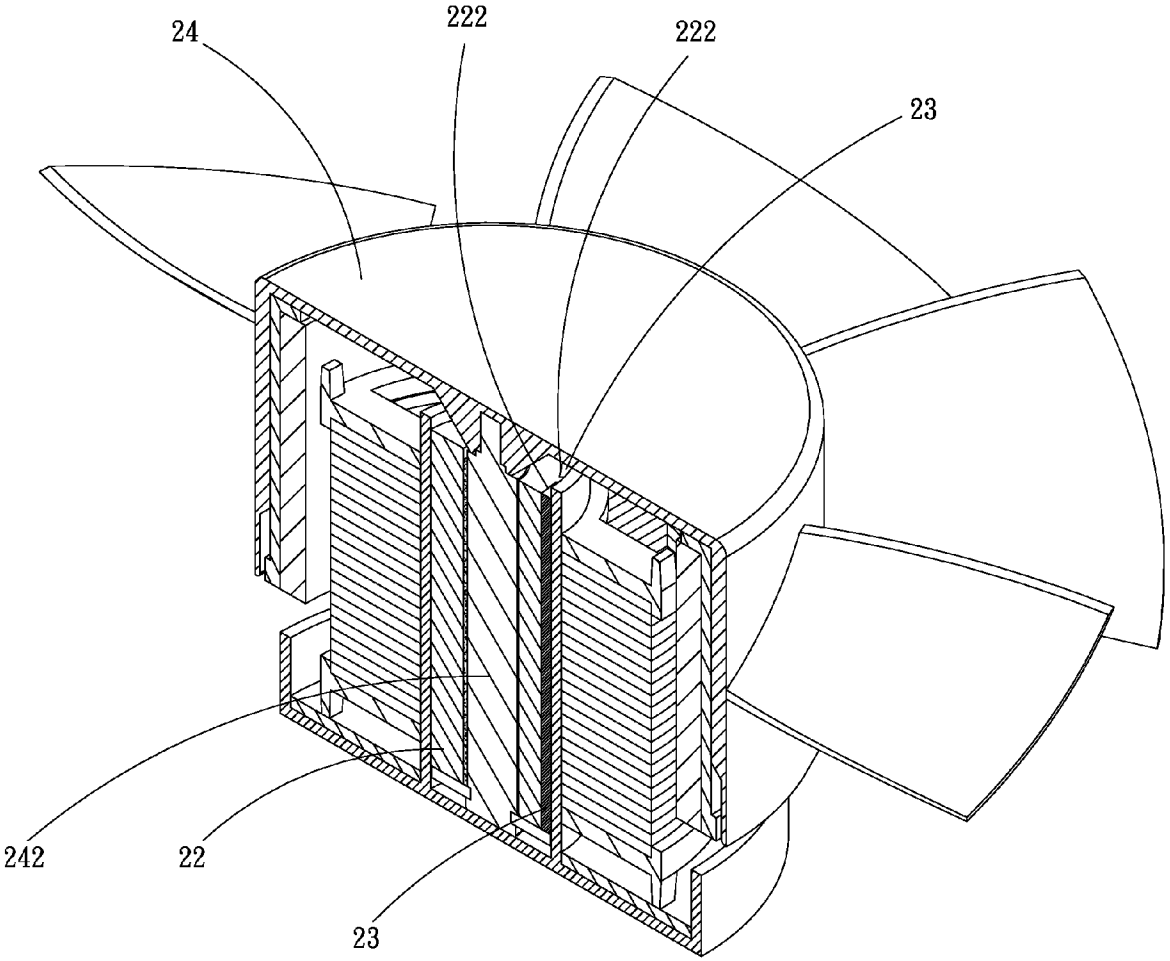
FIG. 8 is a perspective sectional assembled view of a fourth embodiment of the present invention.
Figure 9:
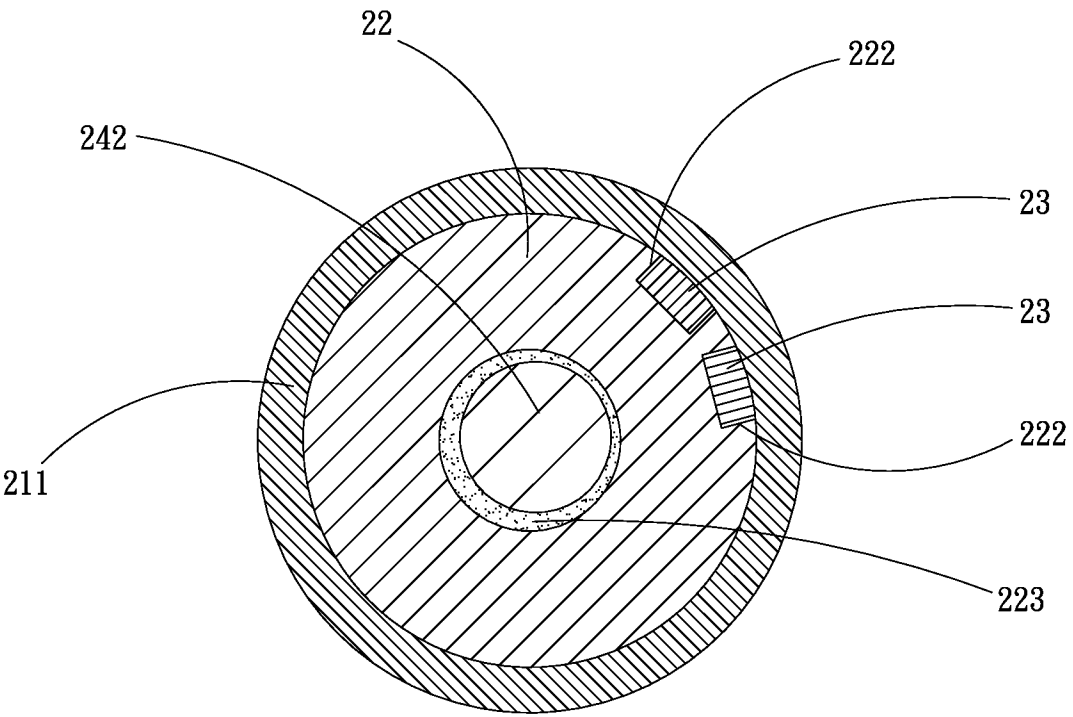
FIG. 9 is a plane view of a part of the fourth embodiment of the present invention.

Please refer to FIGS. 8 and 9. FIG. 8 is a perspective sectional assembled view of a fourth embodiment of the present invention. FIG. 9 is a plane view of a part of the fourth embodiment of the present invention. The fourth embodiment is substantially identical to the first embodiment in component, connection relationship and operation and thus will not be repeatedly described hereinafter. The fourth embodiment is different from the first embodiment in that the oil-retaining bearing 22 has multiple receiving holes 222. In this embodiment, two receiving holes 222 are, but not limited to, disposed on the outer circumference of the oil-retaining bearing 22. (Alternatively, the receiving holes 222 can be disposed on the inner circumference of the oil-retaining bearing 22, in the oil-retaining bearing 22 between the inner and outer circumferences thereof or respectively disposed on the inner and outer circumferences of the oil-retaining bearing 22). The magnetic members 23 are disposed in the receiving holes 222 to locate the shaft 242 in the optimal operation position. In operation of the fan impeller 24, under the magnetic attraction force of the magnetic members 23, the shaft 242 can be kept in the optimal operation position. Accordingly, the stability of operation of the shaft 242 within the oil-retaining bearing 22 can be enhanced to reduce wear and lower the noises and vibration of the fan device in operation. Therefore, the lifetime of the fan device can be prolonged.

The above embodiments are only used to illustrate the present invention, not intended to limit the scope thereof. It is understood that many changes and modifications of the above embodiments can be made without departing from the spirit of the present invention. The scope of the present invention is limited only by the appended claims.

What is claimed is:

1. An oil-retaining bearing fan device comprising:

a fan base seat having a bearing cup on one side, the bearing cup having a bearing hole;

at least one oil-retaining bearing disposed in the bearing hole, the oil-retaining bearing having an inner surface defining a shaft hole and at least one receiving hole, the at least one receiving hole having a length, a depth and a width and being formed as a recess in the inner surface of and extending the length of the oil-retaining bearing and extending from a top to a bottom of the oil-retaining bearing;

at least one elongate magnetic member embedded in the receiving hole and extending from between the top to the bottom of the oil-retaining bearing; and a fan impeller having multiple blades and a shaft, the shaft being rotatably disposed in the shaft hole, the magnet thereby being stationary with respect to the rotatable shaft and a magnetic attraction force is applied by the elongate magnetic member along the length of the shaft.

2. The oil-retaining bearing fan device as claimed in claim 1, wherein a hydraulic layer is filled between the shaft and a wall of the shaft hole.

3. The oil-retaining bearing fan device as claimed in claim 1, wherein the oil-retaining bearing has multiple receiving holes, the receiving holes are respectively formed on an inner circumference and an outer circumference of the oil-retaining bearing.

4. The oil-retaining bearing fan device as claimed in claim 1, wherein the magnetic member is selected from a group consisting of magnetic iron, magnetic powder.

* * * * *